US012404123B2

(12) United States Patent
Olpak et al.

(10) Patent No.: US 12,404,123 B2
(45) Date of Patent: Sep. 2, 2025

(54) PRINTING PLATE PICKING SYSTEM AND PROCESS

(71) Applicant: Eastman Kodak Company, Rochester, NY (US)

(72) Inventors: Tamir Olpak, Petah Tiqwa (IL); Alon Levy, Oranit (IL)

(73) Assignee: EASTMAN KODAK COMPANY, Rochester, NY (US)

( * ) Notice: Subject to any disclaimer, the term of this patent is extended or adjusted under 35 U.S.C. 154(b) by 246 days.

(21) Appl. No.: 17/973,718

(22) Filed: Oct. 26, 2022

(65) Prior Publication Data

US 2024/0140743 A1 May 2, 2024

(51) Int. Cl.
*B65H 3/06* (2006.01)
*B65H 3/08* (2006.01)
*B65H 3/40* (2006.01)

(52) U.S. Cl.
CPC ..... *B65H 3/06* (2013.01); *B65H 3/0816* (2013.01); *B65H 3/40* (2013.01); *B65H 2405/351* (2013.01); *B65H 2405/52* (2013.01); *B65H 2701/1928* (2013.01)

(58) Field of Classification Search
CPC ..... B65H 3/06; B65H 3/44; B65H 3/0816; B65H 3/40; B65H 2405/351; B65H 2405/52; B65H 2701/1928
See application file for complete search history.

(56) References Cited

U.S. PATENT DOCUMENTS 6,651,561 B2 * 11/2003 Koizumi ..... B41C 1/1083 101/477
6,776,097 B2 * 8/2004 Takeda ..... B65H 1/14 271/106
7,604,231 B2 10/2009 Yuen et al.
2008/0179003 A1 7/2008 Yuen

OTHER PUBLICATIONS

Kodak Magnus VLF Platesetter Brochure, 2022.

* cited by examiner

*Primary Examiner* — Howard J Sanders
(74) *Attorney, Agent, or Firm* — David A. Novais

(57) ABSTRACT

A printing plate picking mechanism includes a plate cassette stacking mechanism having an array of plate cassettes, each plate cassette adapted to hold a plurality of printing plates separated by intervening sheets of paper. A plate cassette movement mechanism is adapted to move a selected plate cassette to a printing plate loading position. A plate picker is adapted to contact and hold the leading edge of the topmost printing plate and transport it to plate transport pinch rollers. A paper picking unit includes a paper picker adapted to contact and hold a leading edge of a topmost sheet of paper in the selected plate cassette, and a plate guide positioned above the paper picker to guide the printing plate held by said plate picker. A vertical alignment system is adapted to vertically align the plate picker and the paper picking unit with the selected plate cassette.

10 Claims, 15 Drawing Sheets

PRINTING PLATE PICKING SYSTEM AND PROCESS

FIELD OF THE INVENTION

The present invention pertains to the field of printing plate loading systems and processes, and more particularly to the field of picking and conveying printing plates and interspersed slip sheets or paper from a plate cassette for conveyance to an imaging apparatus or system.

BACKGROUND OF THE INVENTION

In the commercial printing industry, a step in the preparation of images for printing is the transfer of image information to an image recordable material that can be used repeatedly to print the image. While the image recordable material can take a variety of forms, one common form is a printing plate that includes a surface that can be modified in an image-wise fashion. Printing plates can take different forms. In one embodiment the modifiable surface includes a special coating referred to as an emulsion. An emulsion is a radiation sensitive coating that changes properties when exposed to radiation such as visible, ultraviolet, or infrared light. An emulsion can include one or more layers that are coated onto a substrate. The substrate can be composed of a variety of materials such as aluminum, polyester or elastomers.

The transfer of image information to an image recordable material or the printing plate can be done in a variety of methods. One method in which image information is transferred to an image forming material is by computer-to-plate (CTP) systems. In CTP systems, images are formed on the modifiable surface of an image recordable material by way of radiation beams or the like generated by an imaging head in response to image forming information. In this manner, images can be quickly formed onto the image recordable material.

It is advantageous to automate CTP systems to provide for shorter print runs and faster turn-around times. A CTP system can automate, through the use of computers and special equipment, the transfer of information from a digital file describing an original page layout to a printing plate. In these types of CTP systems, unexposed printing plates are normally supplied in packages or cassettes in numbers that can range from a few dozen to several hundred, with slip-sheets (hereinafter referred to as paper or sheets of paper) interspersed between adjacent printing plates. The surfaces of these plates are delicate and sensitive and can be easily marred, which can result in undesirable defects in the final printed product. In order to protect the surfaces of these plates that are supplied in packages or cassettes, a sheet of paper is interspersed between the plates and provide a physical barrier between the plates. However, these sheets of paper need to be removed from between the printing plates prior to imaging. Therefore, any attempt to automate the handling of printing plates must include measures to prevent damage to the delicate modifiable surfaces of the plates and measures to also move the interspersed sheets of paper to a paper disposal unit in an automated fashion.

The automation of paper removal and storage in this context presents a number of challenges. Paper removal is not simply a matter of moving a single sheet of paper from a stack of similar sheets of paper. In general, paper is made from materials different from those used for printing plates, and in particular is a material suitable for protecting and not damaging the modifiable surfaces of the printing plates.

Separating a sheet of paper from an adjacent printing plate can be complicated when the sheet of paper becomes adhered to a surface of the adjacent printing plate by physical mechanisms that can include electrostatic attraction or the expulsion of air between the surfaces. These mechanisms can lead to multiple plate picks that can lead to system error conditions. Increasing plate-making throughput requirements complicate matters further by necessitating that the sheets of paper be removed at rates that do not hinder the increased plate supply demands.

Conventional printing plate picking systems have typically picked and removed printing plates and interspersed sheets of paper sequentially from a media stack. For example, in some conventional systems, a sheet of paper is first picked from the media stack and moved to a disposal container. Once the sheet of paper has been moved, a printing plate is then picked and moved to a subsequent station where it is processed (e.g., by imaging in an exposure engine). In other conventional systems, a sheet of paper is picked and transferred to a disposal container after the printing plate has been secured and transferred to a subsequent process. In either case, the sequential picking and removal steps can adversely affect the overall system throughput times.

Once a sheet of paper has been secured and separated from a printing plate, its reliable disposal presents additional challenges for automated media handling systems. Specifically, in a device designed to have a large number of printing plates on-line at any one time, the sheets of paper that are removed each time a plate is picked must be accumulated somewhere for disposal. Conventional plate-making systems have employed complex media handling mechanisms that remove and convey sheets of paper to containers such as slip-sheet or paper holders. The reliability and throughput of the media handling system may be adversely affected when a picked sheet of paper must be additionally conveyed and deposited into a slip-sheet holder. Further, when sheets of paper are crumpled during the act of picking, separating, conveying or depositing them into a slip-sheet or paper holder, the sheets of paper can occupy a significant volume that increases the size of the slip-sheet or paper holder, thus adversely impacting the required footprint of the plate-making system.

Additionally, conventional plate loading and paper removal systems may require extensive floor space for accommodating a plate storage area, an imaging system and a transport space for moving a picked plate from the storage area to the imaging unit.

FIG. 1 is a schematic representation of the elements or parts of a conventional printing plate handling system 10 for handling and imaging printing plates. The system 10 includes an imaging unit 1 (also referred to as a CTP device) where an image can be recorded on a printing plate. The imaging unit 1 can include an exposure system which is designed to record an image on the plate. In an automated arrangement, the printing plate handling system 10 can include an autoloader unit 3 that interfaces with a plate cassette array 5. The plate cassette array 5 is designed to hold a stack of cassettes where each cassette in the stack of cassettes can each hold a plurality of plates that are to be picked and conveyed to the imaging unit 1 through the use of autoloader unit 3 to enable the imaging of the printing plate. In some cases, each cassette can hold a different type or size of plate to enable the automatic creation of different types of plates.

FIG. 2 shows a known plate picking mechanism 20 of the type used in the KODAK MAGNUS VLF Platesetter Multi- Cassette Unit The plate picking mechanism 20 is adapted to load or convey plates 23 from a plate cassette 53*a* located in a plate cassette array 53 to an imaging unit 1 (FIG. 1) such as a CTP device. FIG. 2 illustrates the interface between the plate picking mechanism 20 and the top or uppermost plate 23 in a plate stack 22 in a plate cassette 53*a*. As shown in FIG. 2, the plate picking mechanism 20 includes a plate picking arrangement 27 that includes vacuum or lifting cups 29 mounted on a conveying arm 31 that is adapted to move the lifting cups 29 from a first position to a picking up position where the lifting cups 29 contact and pick or lift the uppermost plate 23 in the plate stack 22. Once the uppermost plate 23 is lifted, the plate picking mechanism 20 further includes a plate support device 24 that is adapted to be moved to a position below the picked-up printing plate 23 as shown in FIG. 2. The plate support device 24 includes an air suction arrangement that is designed to hold the plate 23 on an upper surface 24*a* of the plate support device 24 by way of the application of an air suction force on the lower surface of the plate 23. The plate support device 24 also includes a paper sheet lifting and conveying mechanism 33 that is designed to lift a sheet of paper 35 that is interspersed between the lifted uppermost plate 23 and the next plate 23 in the plate stack 22 in the plate cassette 53*a*. In the arrangement of FIG. 2, the plate support device 24 is adapted to convey the picked-up plate 23 over a plate support 26 to an imaging unit 1 (FIG. 1) or CTP device, and is further adapted to convey the sheet of paper 35 to rollers 39 which direct the sheets of paper 35 into the disposal bin or paper disposal unit.

In the arrangement of FIG. 2, the plate cassette array is provided in a fixed vertical alignment or arrangement with a vertical gap 25 between the individual cassettes 53*a*, 53*b* in the plate cassette array 53. The vertical gap 25 between adjacent plate cassettes 53*a*, 53*b* is sized and configured to permit the insertion of the plate picking arraignment 27 including the lifting cups 29, conveying arm 31 and plate support device 24 therein to convey a plate 23 and sheet of paper 35. This layout, which requires the handoff of the picked-up plate 23 to plate support device 24 and therefore includes the application of a vacuum force by separate elements along a plate transport path, also expands the footprint of the system, including the footprint of the system in a vertical direction.

A further alternative known arrangement is the Agfa Advantage 3850 CL & CLS Cassette System. The Agfa 3850 system is an automatic flatbed violet laser Platesetter that enables access to the media stored within cassettes. The printing plates that are loaded in the Agfa 3850 system are sensitive to visible light, so the cassettes are designed to be light tight, and the cassettes are intended to be loaded in a separate room that is equipped with safelights. Once loaded with media the sealed cassette is moved to a trolley and docked to a CTP device. Inside the CTP device of the Agfa 3850 system a cassette support frame is positioned vertically by a scissor lift mechanism to receive the new cassette and roller guides are used to permit the cassettes to be automatically accessible within the CTP. When a specific media size is needed a cassette containing that media size is moved vertically to a picking height by the scissor lift mechanism. An air cylinder is used to horizontally locate the cassette at a picking position. In this system a mechanism guided by vertical slides is used to lower a front cover of the cassette to allow a picking mechanism to gain access to the media within. For removing media from the cassette, the Agfa 3850 system uses a stepper motor to horizontally move the picking mechanism along a central track and rod cylinders are used to vertically guide the picking mechanism. Suction cups mounted on the picking mechanism are used to pick the leading edge of the upper most interleaf paper and move the paper horizontally to a set of pinch rollers that pull the paper downwards into a bin. This same picking mechanism returns to the cassette to pick the leading edge of the upper most plate using the same suction cups and moves the plate horizontally to capstan rollers which control the plate position during imaging on the flatbed platen. The Agfa 3850 system uses the same mechanism to sequentially move the interleaf paper and then the plate as opposed to moving both the interleaf paper and plate in a substantially parallel manner. This impacts the processing speed of the device and requires design compromises to enable a single mechanism to handle different media types (i.e., plates and paper).

In an alternative known arrangement, the plates in a plate cassette array can be stacked in a fixed staggered arrangement that permits the leading edge of the plates and sheets of paper to be accessed by the plate picking arrangement. This staggered arrangement expands the horizontal footprint of the device.

What is desired is a mechanism or arrangement having a reduced footprint that is capable of moving both interleaf paper and plates in a substantially parallel manner while protecting the plate from being damaged while it is conveyed.

SUMMARY OF THE INVENTION

The present invention provides for an apparatus and process that is adapted to remove a printing plate from a plate stack in an array of plate cassettes that include printing plates and interspersed sheets of paper, wherein the apparatus is adapted to move a printing plate and sheet of paper in a substantially simultaneous manner to load the printing plate into an imaging system such as a CTP device, and to dispose the interspersed sheets of paper into a paper bin.

In the apparatus of the present invention, an array of plate cassettes is arranged in a vertical configuration in a manner which minimizes the vertical spacing between adjacent stacked cassettes to thereby decrease a vertical footprint of the apparatus, and each of the cassettes in the stack is adapted to individually move horizontally with respect to the stack to provide for an opening that permits the insertion of a plate picker device and a paper picker device to convey plates and sheets of paper from the cassette.

More specifically, the present invention relates to a printing plate picking mechanism, including:

(i) plate transport pinch rollers adapted to direct a printing plate along a plate transport path;

(ii) a paper disposal unit;

(iii) a plate cassette stacking mechanism including:

(a) an array of plate cassettes, each plate cassette adapted to hold a plurality of printing plates separated by intervening sheets of paper; and (b) a plate cassette movement mechanism adapted to move a selected plate cassette to a printing plate loading position thereby exposing a leading edge of a topmost printing plate in the selected plate cassette;

(iv) a plate picker adapted to contact and hold the leading edge of the topmost printing plate and transport it to the plate transport pinch rollers;

(v) a paper picking unit including:

(a) a paper picker adapted to contact and hold a leading edge of a topmost sheet of paper in the selected plate cassette; and (b) a plate guide positioned above the paper picker, said plate guide forming a part of said plate transport path to guide the printing plate held by said plate picker to said plate transport pinch rollers; and (vi) a vertical alignment system adapted to move the array of plate cassettes or the paper picking unit in a vertical direction to vertically align the paper picking unit with the selected plate cassette.

BRIEF DESCRIPTION OF THE DRAWINGS

It is to be understood that the attached drawings are for purposes of illustrating the concepts of the invention and may not be to scale. Identical reference numerals have been used, where possible, to designate identical features that are common to the figures.

DETAILED DESCRIPTION OF THE INVENTION

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated, or as are readily apparent to one of skill in the art. The use of singular or plural in referring to the "method" or "methods" and the like is not limiting. It should be noted that, unless otherwise explicitly noted or required by context, the word "or" is used in this disclosure in a non-exclusive sense.

Figure 1:
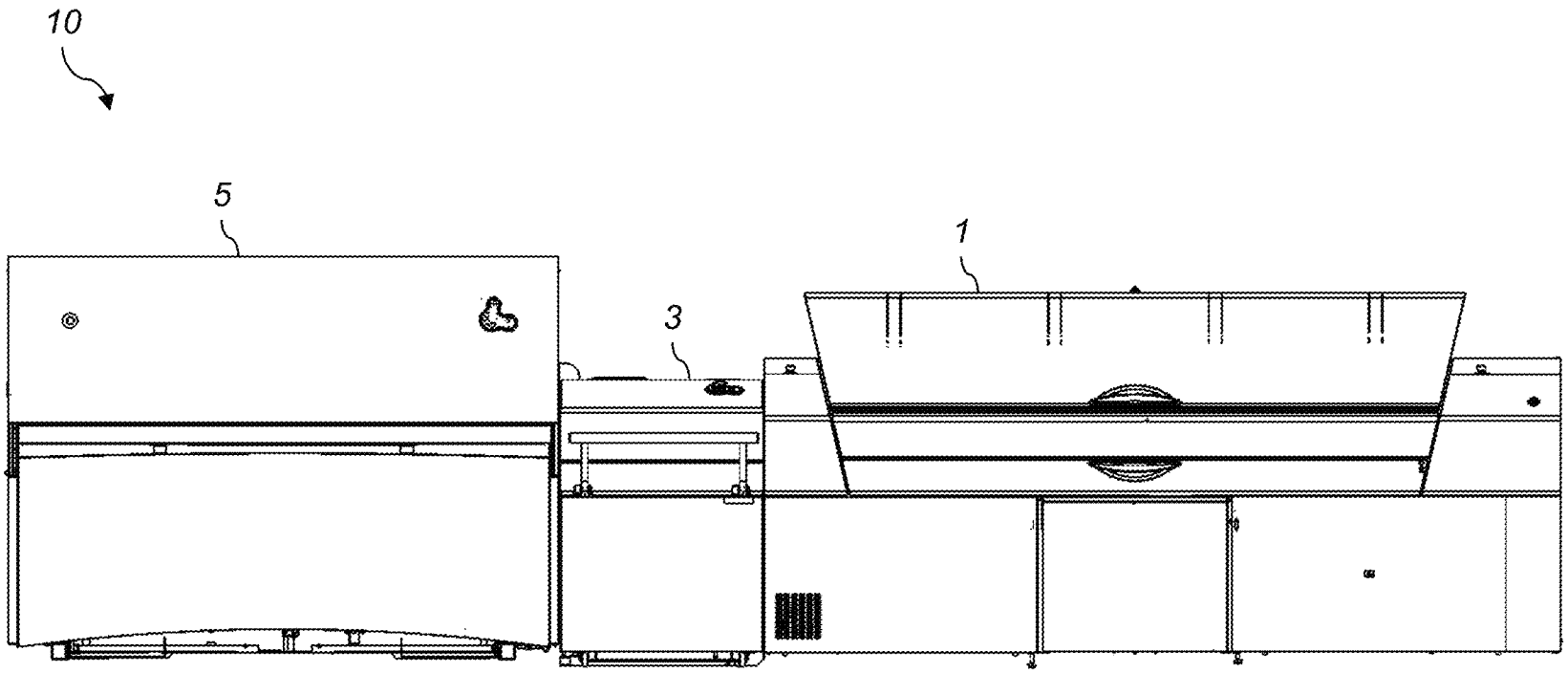
FIG. 1 (Prior Art)
FIG. 1 is a schematic representation of a conventional CTP system.
Figure 2:
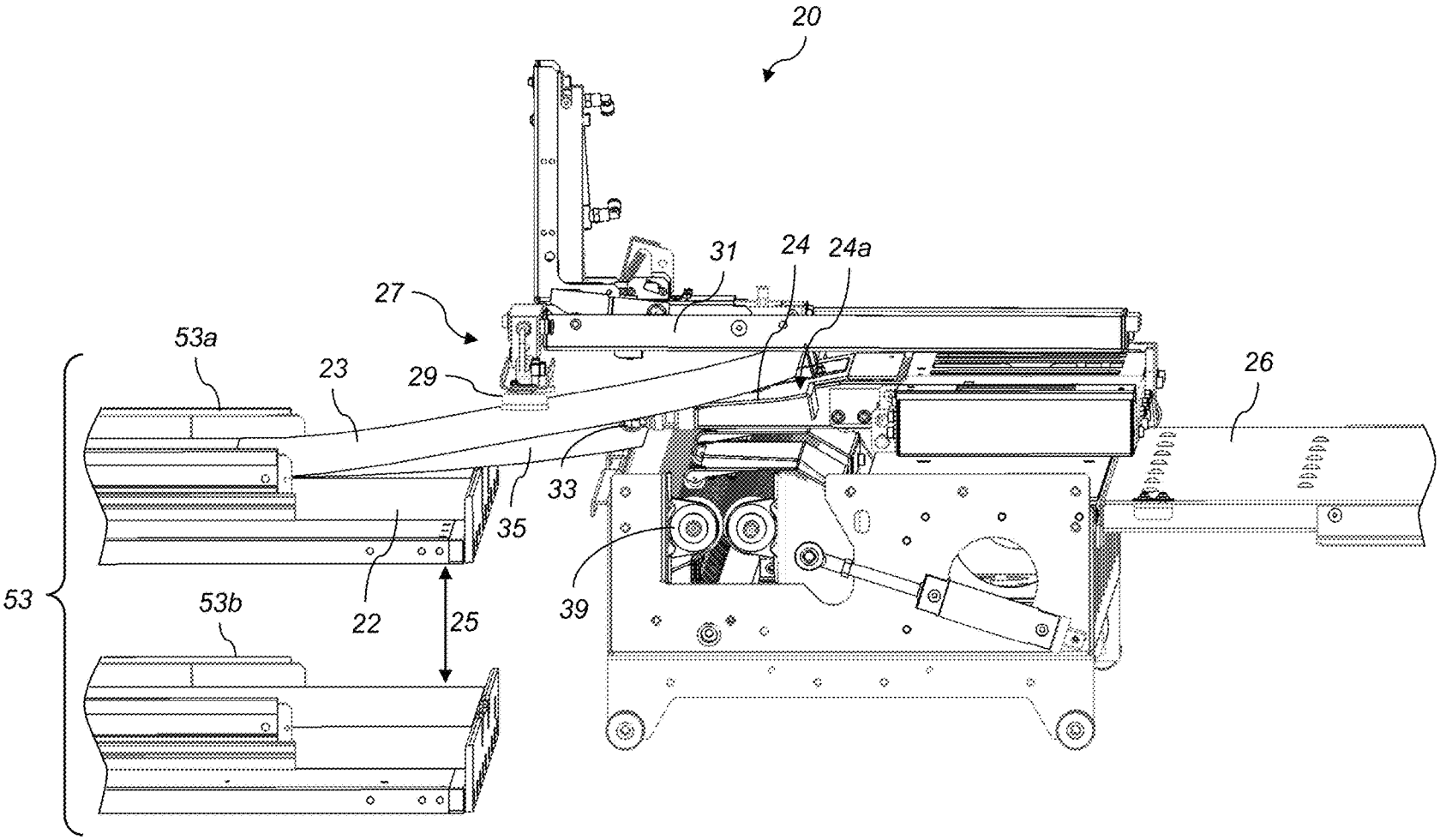
FIG. 2 (Prior Art)
FIG. 2 shows a known plate picking mechanism.
Figure 3:
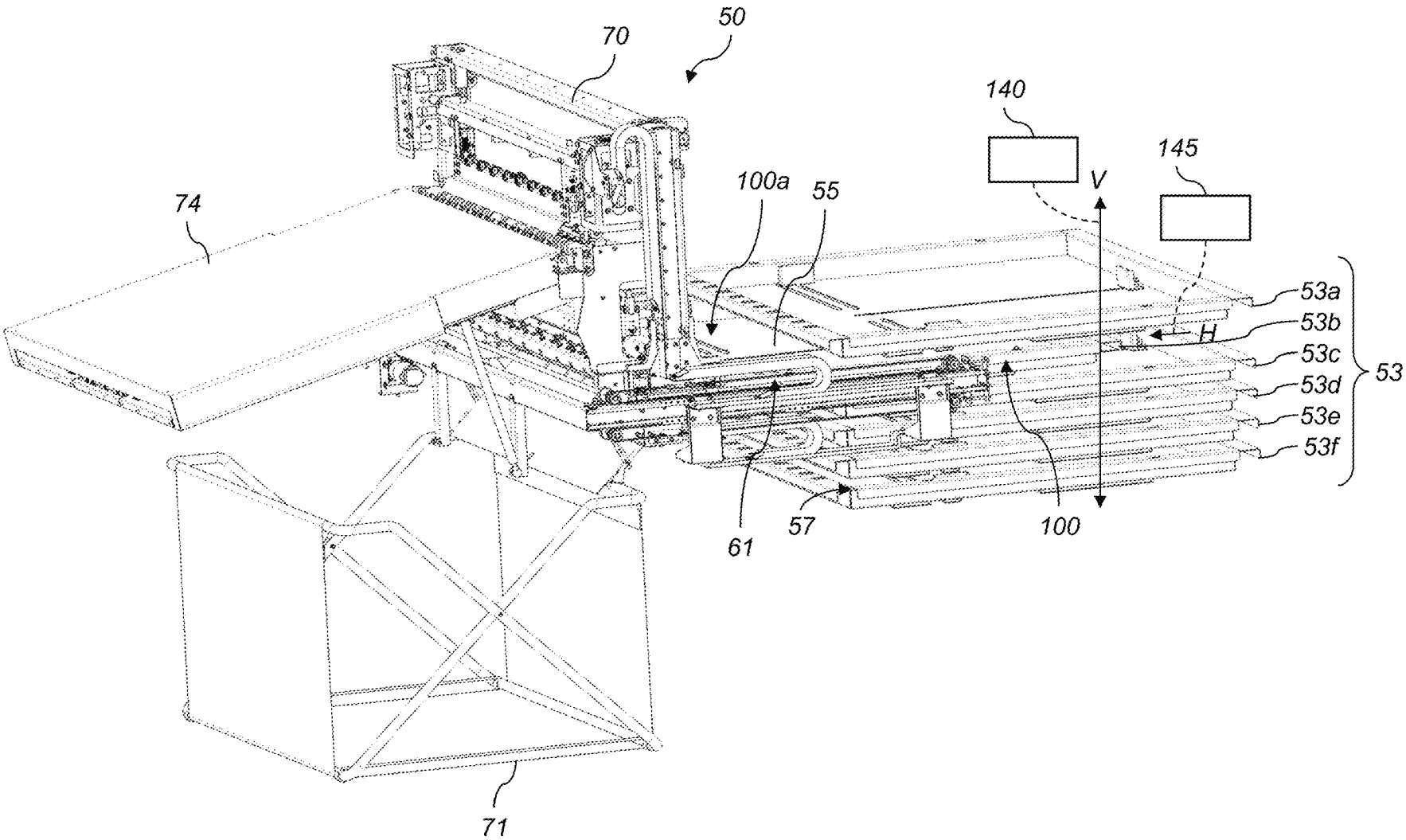
FIG. 3 shows an exemplary printing plate picking mechanism.

FIG. 3 illustrates an exemplary printing plate picking mechanism 50 including a plate picker and paper picker mechanism 70 (also described herein as a plate picker and paper picker unit, assembly or arrangement) in accordance with a feature of the present invention. The printing plate picking mechanism 50 can be part of an overall system as schematically illustrated in FIG. 1. As shown in FIG. 3, the printing plate picking mechanism 50 includes a plate cassette stacking mechanism or plate cassette array 53 which comprises a stack a plate cassettes 53*a*-53*f* which are each configured to hold a plurality a printing plates 55 with interspersed or intervening sheets of paper. As shown in FIG. 3, the plate cassettes 53*a*-53*f* in the plate cassette array 53 are vertically aligned in a stack in a manner which minimizes a spacing 57 between adjacent plate cassettes 53*a*-53*f* and therefore minimizes the overall size of the plate cassette array 53 in the vertical direction.

In accordance with the present invention, a selected plate cassette 100 (plate cassette 53*b* in FIG. 3) can be conveyed from a home position where all of the plate cassettes 53*a*-53*f* in the paper cassette array 53 are horizontally aligned (for example, reference is made to the horizontally aligned position of each plate cassette 53*a* and 53*c*-53*f* in FIG. 3 which are all in the same horizontal position) to a printing plate loading position 61. This is achieved by moving the selected plate cassette 100 to the cassette loading position 61 in direction H. FIG. 3 shows the selected plate cassette 100 (i.e., plate cassette 53*b*) after movement of the selected plate cassette 100 in direction H to the loading position 61. When the selected plate cassette 100 is moved to the printing plate loading position 61, an exposed portion 100*a* of a topmost printing plate 55 (including the leading edge of the printing plate 55) is exposed in the cassette 53*b*.

The movement of the selected plate cassette 100 can be achieved by any known type of plate cassette movement mechanism 145 that is adapted to move the selected plate cassette 100 in horizontal direction H to position the selected plate cassette 100 in the loading position 61. In some embodiments, the plate cassette movement mechanism 145 can include and be adapted to use one or more motors to drive wheels attached to the selected plate cassette 100 or any other type of lever, gear, hydraulics, rack and pinion, cables and pulleys, etc., that is adapted to move the selected plate cassette 100 in a horizontal manner in direction H. As a further option, a selected plate cassette 100 can be adapted to be manually pushed or pulled to the loading position 61.

In a further feature of the invention, a vertical alignment system 140 can be used to move the plate cassettes 53*a*-53*f* in the plate cassette array 53 vertically through any known driving means for achieving vertical movement. For example, the cassettes can be operationally associated with a drive screw or a belt drive or the like which can be driven by a motor to cause a corresponding vertical movement of the plate cassette array 53 to vertically align the selected plate cassette 100 with the loading position 61. Alternatively, the vertical alignment system 140 can be adapted to move the plate picker and the paper picking unit 70 in the vertical direction V to vertically align the selected plate cassette 100 with the plate picker and paper picker unit 70.

As described with reference to FIG. 1, an auto-loader unit 3 is adapted to interface with the plate cassette array 5. With reference to FIG. 3, an auto loader unit in accordance with the present invention includes the plate picker and paper picker mechanism 70 which interfaces with the plate cassette array 53. In an automated CTP system, a printing plate 55 can be moved from a selected plate cassette 100 in an automated matter so as to be conveyed to an imaging unit 1 (FIG. 1), while in a substantially parallel manner an interspersed sheet of paper can also be conveyed in an automated matter to a paper bin or paper disposal unit 71.

As noted, relative to FIG. 3, in an embodiment of the present invention, the plate cassettes 53*a*-53*f* can be moved in a vertical direction by a known mechanism adapted to move the plate cassettes 53*a*-53*f* to permit the movement of the selected plate cassette 100 (e.g., plate cassette 53*b*) to a loading position 61. However, the present invention is not limited thereto, and as an alternative arrangement, elements of the plate picker and paper picker mechanism 70 can also be adapted to move in a vertical direction to align with a selected plate cassette 100 (e.g., plate cassette 53*b*) for moving a top-most printing plate 55 within the selected plate cassette 100 to the imaging unit 1.

The plate picker and paper picker mechanism 70 is adapted to convey a selected printing plate 55 to an imaging device through a plate conveyor 74. The conveyor 74 is adapted to convey a printing plate 55 to a CTP device for imaging. Additionally, with the arrangement of the present invention, the plate picker and paper picker mechanism 70 is further adapted to convey paper to a paper bin or paper disposal unit 71. The plate picker and paper picker mechanism 70 and specifically the plate picker and paper picker operations of the plate picker and paper picker mechanism 70 can work separately and/or as a system. Each of the plate picking and paper picking functions of the plate picker and paper picker mechanism 70 can be a stand-alone unit combined to perform a plate or paper movement from a plate cassette 53*a*-53*f* (printing plate 55 to conveyor 74, and paper to paper disposal unit 71). In a representative example of the present invention, each of the plate picker and paper picker of the plate picker and paper picker mechanism 70 can handle a 50 mm stack of printing plates 55 and paper from a selected plate cassette 100 selected from the set of plate cassette 53*a*-53*f* Additionally, each working plate cassette 53*a*-53*f* can be moved (pushed or pulled by a mechanism) to loading position 61 in order to expose and reveal an exposed potion 100*a*. The exposed portion 100*a* can also be referred to as an operation zone.

Figure 4A:
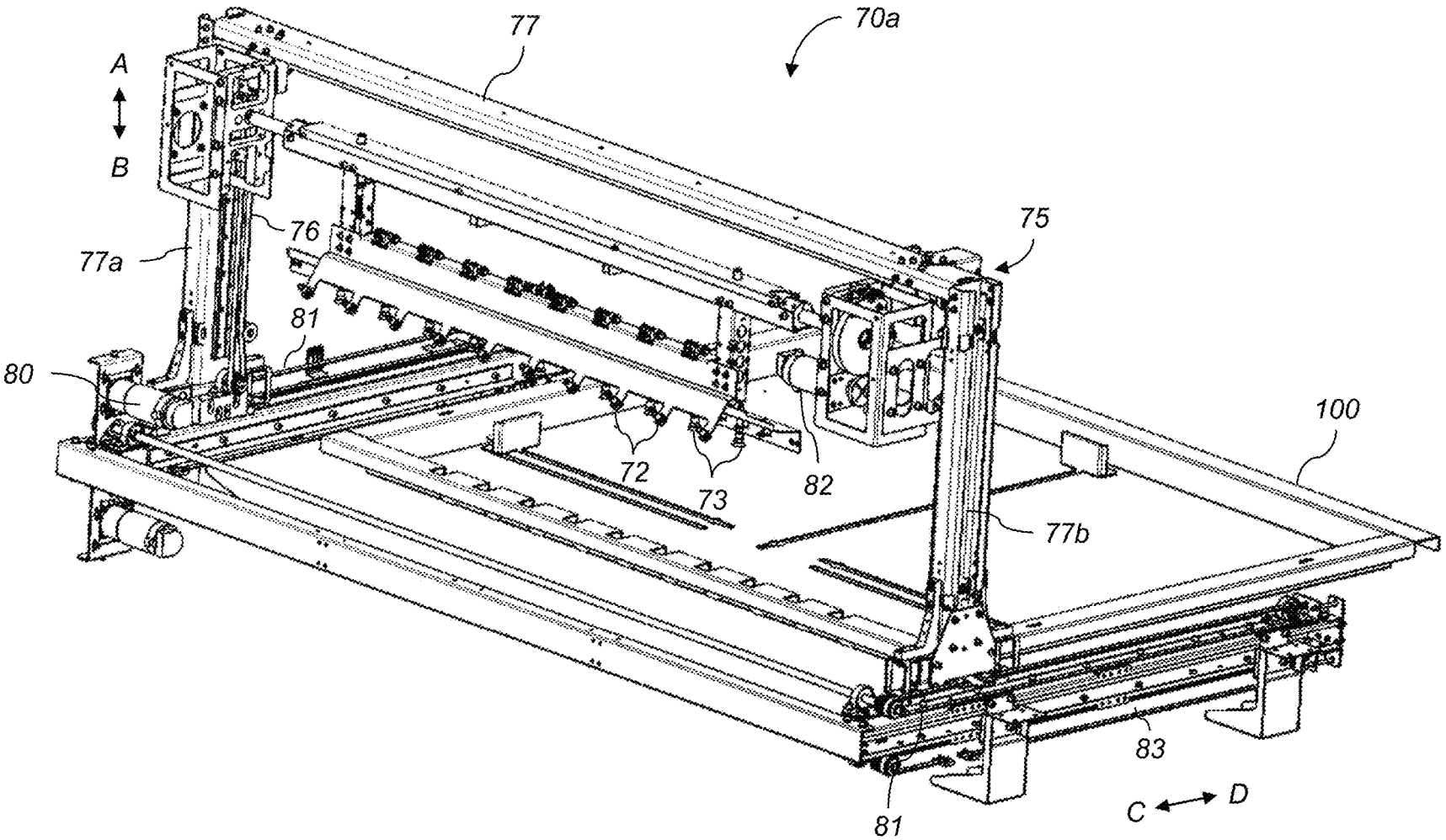
FIGS. 4A-4B show an exemplary plate picker configuration.
Figure 4B:
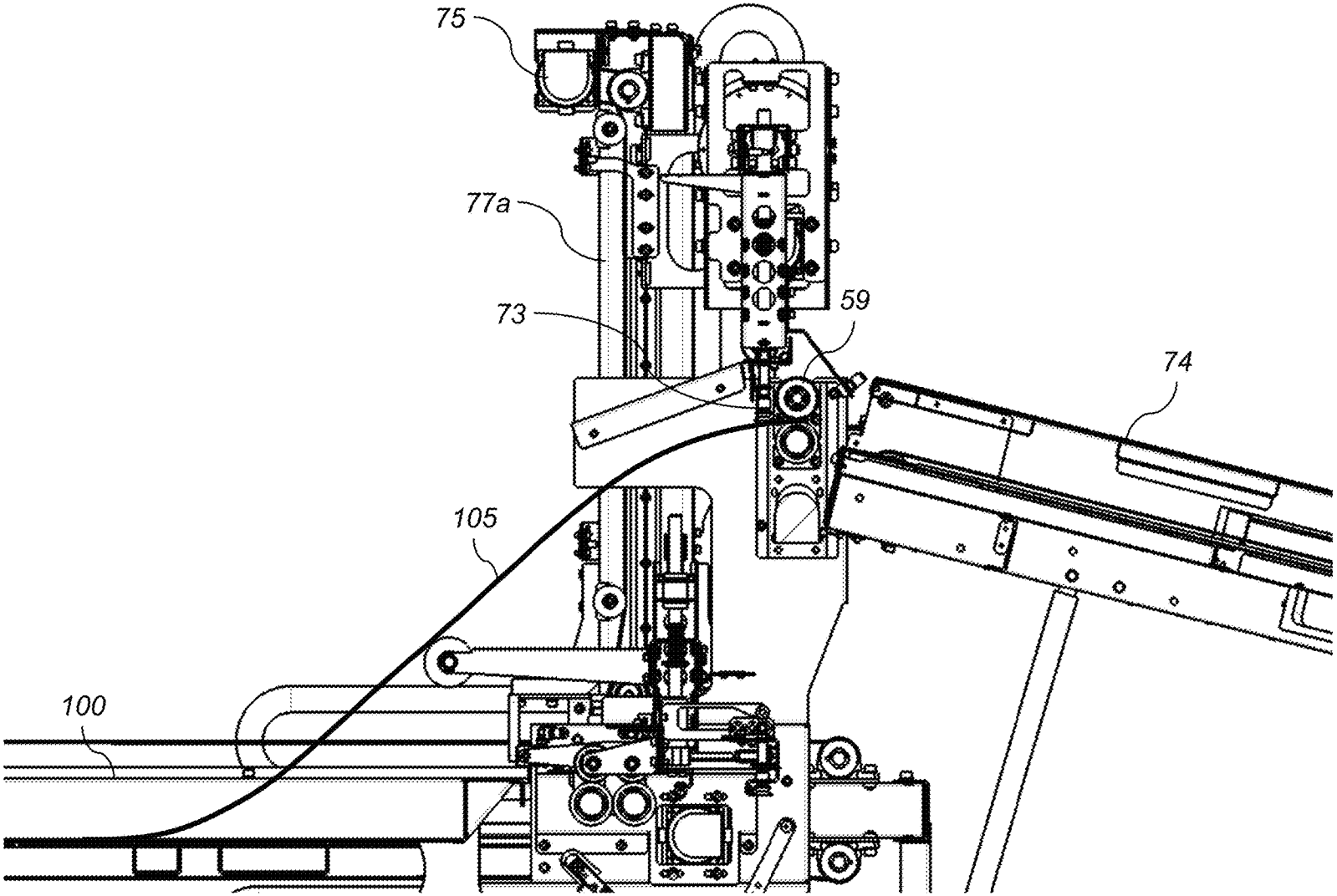

Referring to FIGS. 4A and 4B, a plate picker 70*a* which is part of the plate picker and paper picker mechanism 70 (FIG. 3) is illustrated in isolation. The plate picker 70*a* includes a plurality of vacuum cups 73 (also referred to as suction cups) mounted on an assembly having a horizontal bar or rail 77 and vertical bars or rails 77*a* and 77*b*. The vacuum cups 73 are adapted to apply a suction or vacuum force onto the plate to lift the plate, and is supplied to the vacuum cups 73 by way of ally known vacuum source. The vacuum cups 73 are mounted on rails 77*a*, 77*b* so as to be movable in vertical directions A, B by way of a DC motor 75 and a timing or drive belt 76. The vacuum cups 73 are also movable in horizontal directions C, D along horizontal rails 83 by way of a DC motor 80 and a timing or drive belt 81. In accordance with an embodiment of the invention, the motor 80 and drive belt 81 are operationally associated with vertical rails 77*a*, 77*b* of the assembly upon which the vacuum cups 73 are mounted, such that a driving movement applied by the motor 80 and drive belt 81 causes a corresponding movement of the assembly and thereby the mounted vacuum cups 73 in horizontal directions C, D. In operation, and as will be described in detail, for picking a plate in accordance with the present invention, the vacuum cups 73 are moved through the use of motors 75 and 80 to position the vacuum cups over a printing plate located in a plate cassette by driving the vacuum cups in direction C or D through motor 80 to position the vacuum cups over the plate, and moving the vacuum cups downward in direction B by operation of motor 75 to cause the vacuum cups 73 to contact and hold a selected printing plate. A further tilting motion of the assembly and specifically vacuum cups 73 can be achieved through a DC tilt motor 82 which is adapted to provide a tilting or angular movement of the vacuum cups 73 relative to the bars 77, 77*a* and 77*b*. This can aid in the separation of a picked printing plate 105 from an underlying sheet of paper 400 (e.g., see FIG. 5C) by tilting the vacuum cups 73 relative to a horizontal plane. Air blowers 72 can also be activated to aid in the separation. In some embodiments, the entire assembly can alternatively be tilted.

While the embodiment illustrated in FIG. 4A shows the use of motors and drive belts to achieve the desired movement of the vacuum cups 73, the present invention is not limited thereto. It is recognized that any type of device that is adapted to provide vertical, horizontal and tilting movements such as hydraulics, levers, gears, and rack and pinion arrangements can be utilized within the context of the present invention.

Accordingly, the plate picker 70*a* can be a bar with vacuum cups that attaches and/or is adapted to contact a printing plate 105 and moves the printing plate 105 along a plate transport path from a selected plate cassette 100 to plate transport pinch rollers 59 (see FIG. 4B). The plate transport pinch rollers 59 direct the plate 105 to conveyor 74 (also known as a conveying bridge) to convey the printing plate into an imaging device or CTP device. As noted above, the vacuum cups 73 of plate picker 70*a* can move horizontally, vertically, and can have a tilted (pendulum) movement. The horizontal, vertical and tilting movements can be generated by the illustrated DC motors (75, 80, 82) attached to pulleys that are connected to drive belts 76, 81. The present invention is not limited thereto, and the DC motors can be connected to any belt type, rope or cable. The timing belts can be connected to a bracket and transfer the forces generated from the DC motor to move the plate picker structure. These movements can also be generated by one or more cylinders (hydraulic and/or pneumatic). The arm can be tilted by a DC motor 82 connected to a plate. As also described, the horizontal and vertical movements can be guided by rails, and in a feature of the invention, these movements can be detected by sensors at each relevant position which provide a signal to a control device which is adapted to control the operation of the plate picker and paper picker mechanism 70.

Figure 4C:
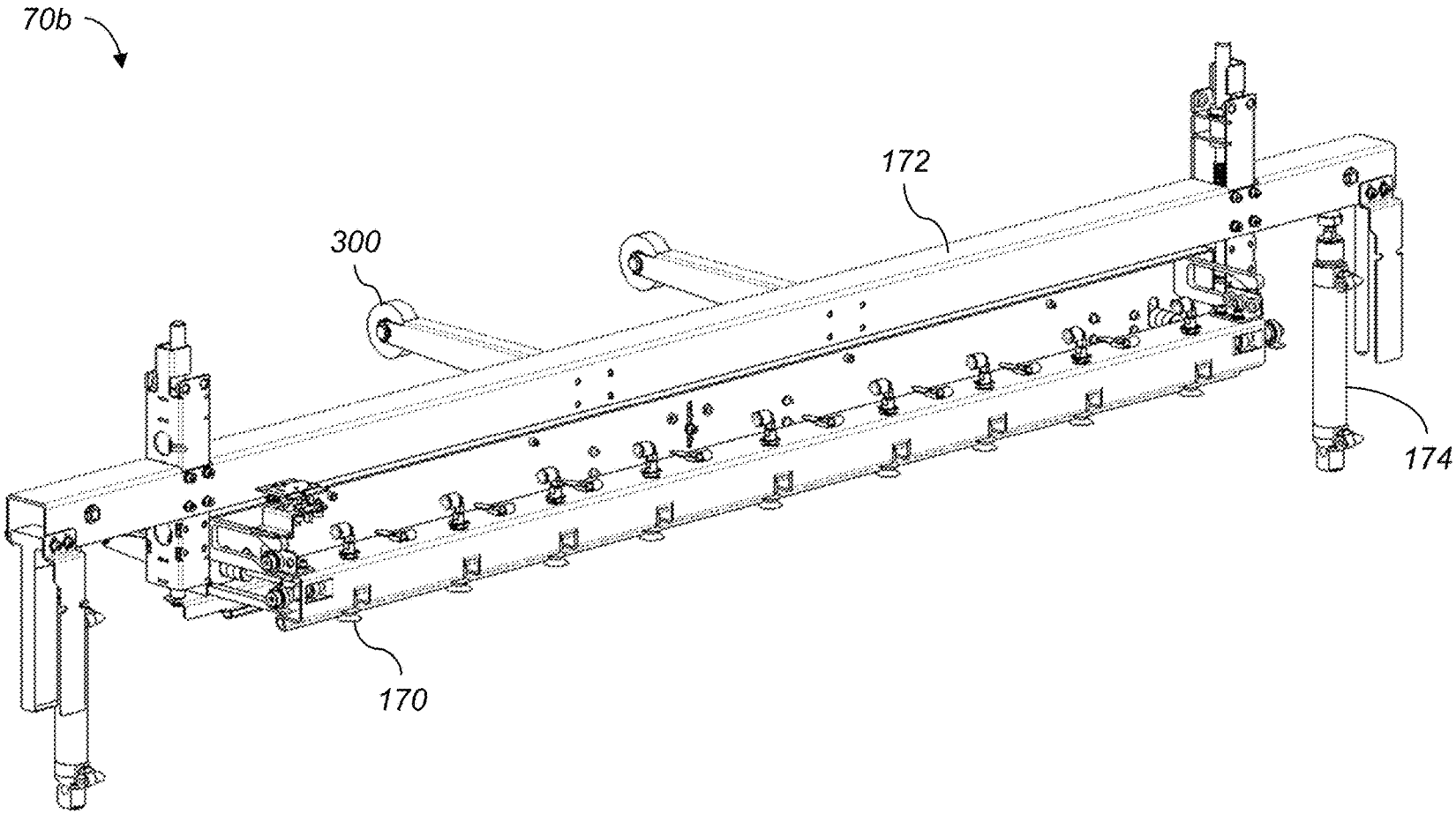
FIGS. 4C-4F show an exemplars paper picker configuration.
Figure 4D:
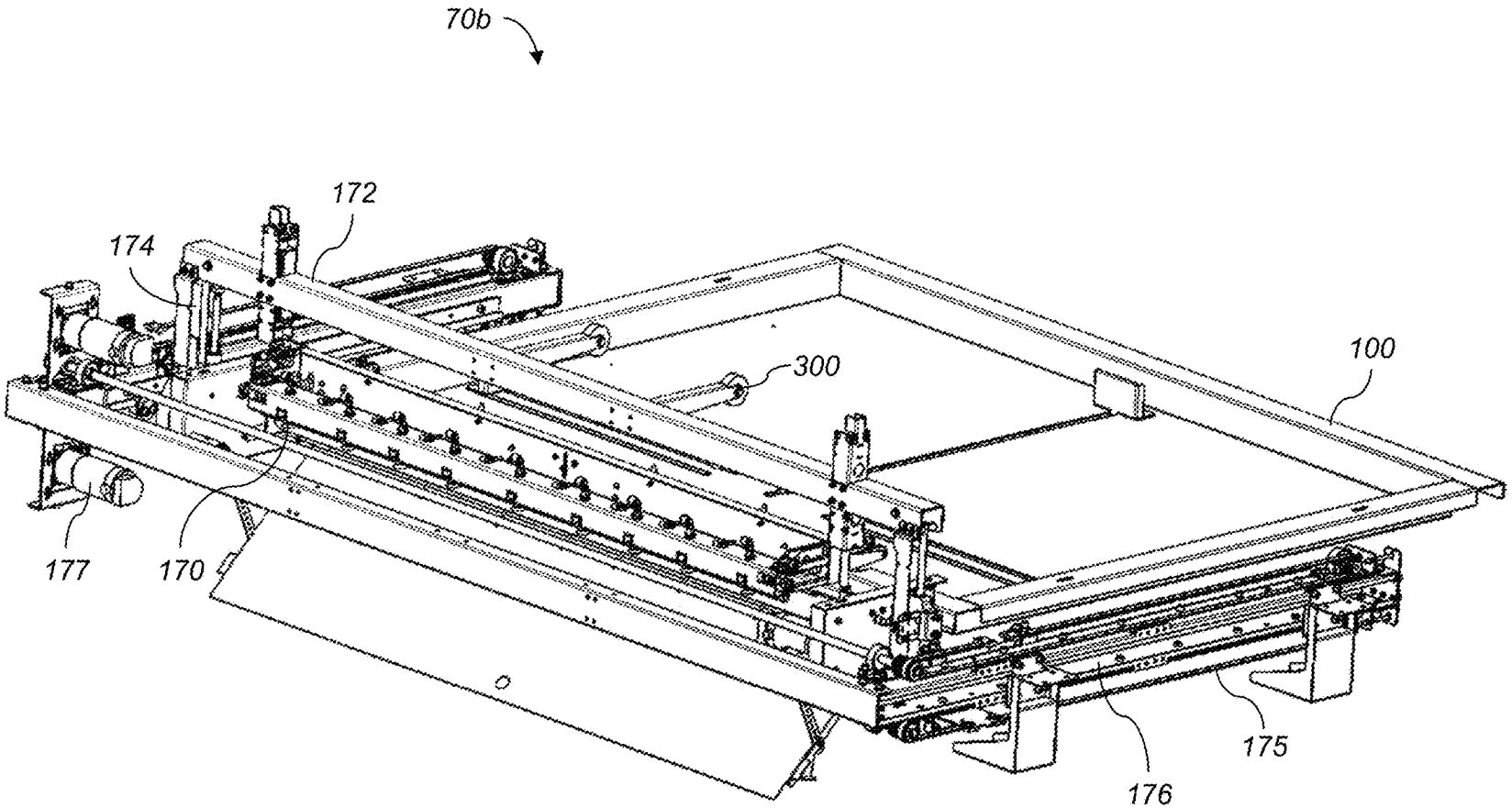

FIG. 4C illustrates in isolation a paper picking unit that includes a paper picker 70*b* which is part of the plate picker and paper picker mechanism 70 (FIG. 3). FIG. 4D shows the paper picker 70*b* in the context of other system components. As shown in FIG. 4C, the paper picker 70*b* includes a plurality of suction or vacuum cups 170 mounted on a bar or rail 172 which makes up part of the paper picker 70*b* or paper picker assembly. The vacuum cups 170 are adapted to apply a suction or vacuum force that is applied onto the paper to lift the paper and is supplied to the vacuum cups 170 by way of any type of known vacuum source. The paper picker 70*b* also includes guide rollers 300 which function as a plate guide to guide a printing plate 105 over the top of the paper picker 70*b*. In other configurations, other types of plate guides can be used instead of guide rollers 300. For example, the plate guides can be a fixed smooth surface that the printing plate 105 can slide over.

The paper picker 70*b* with the rail 172 and the vacuum cups 170 attached thereto is adapted to move vertically through the use of vertical actuators 174 or a motor and drive belt mechanism connected thereto to move the rail 172 vertically. The present invention is not limited to the use of an actuator or a motor and drive belt, and any other type of known driving mechanism adapted to move the bar in the vertical direction can be utilized within the context of the present invention. The paper picker 70*b* can also move horizontally and includes a pair of guide bars or rails 176 which are adapted to guide the paper picker 70*b* in a horizontal direction when driven by an associated drive motor 177 and drive belt 175. For example, the drive motor can be adapted to drive a drive belt attached to a wheel for moving the paper picker 70*b* and specifically the vacuum cups 170 in a horizontal direction along the rails 176. The path that the paper takes is schematically illustrated by paper path shown in FIGS. 4E and 4F.

Figure 4E:
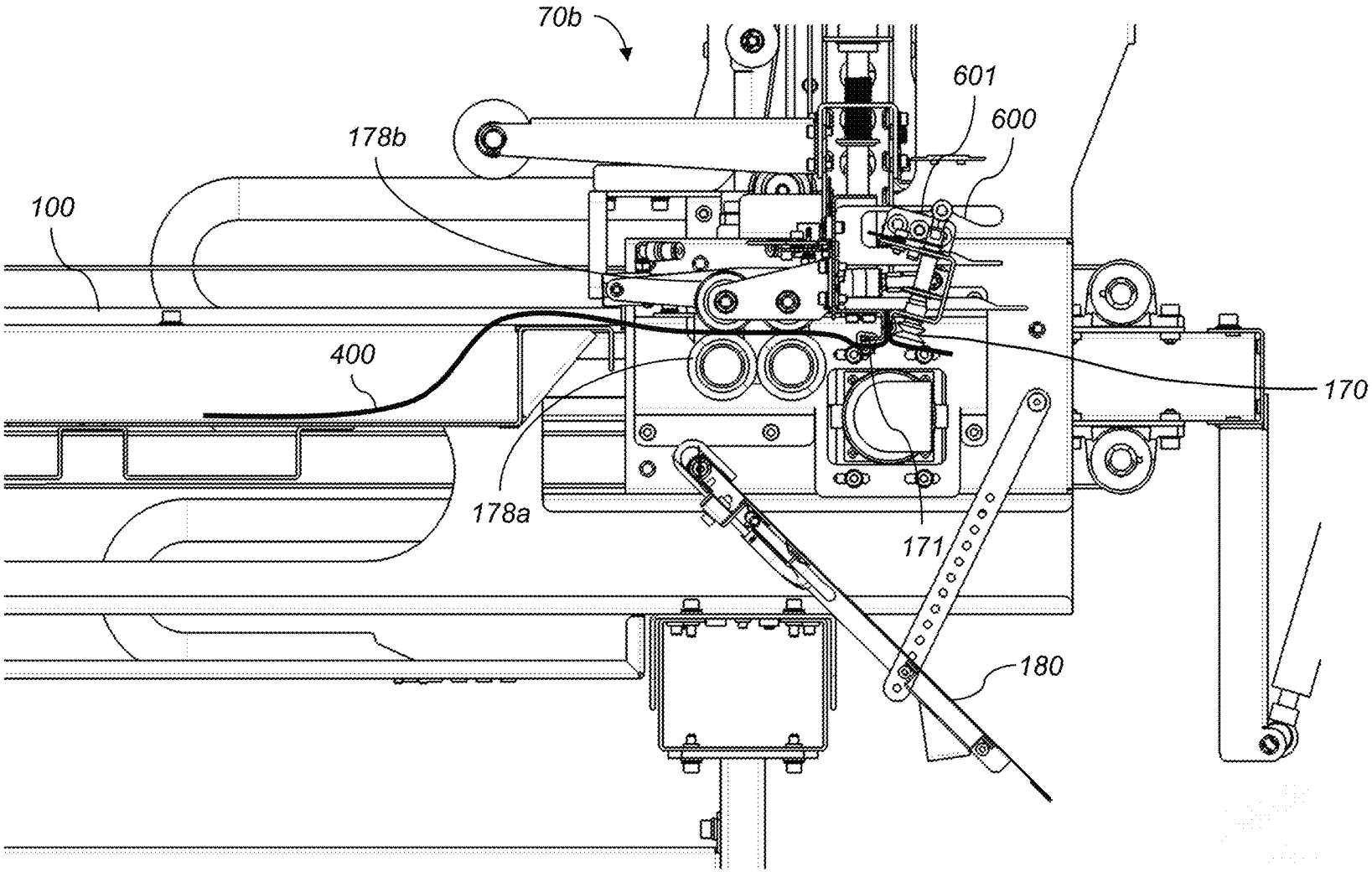

The vacuum cups 170 of the paper picker 70*b* can be positioned over a sheet of paper 400 in the selected plate cassette 100 and activated to lift the sheet of paper 400. The vacuum cups 170 can then be pivoted (e.g., by moving a roller 601 along a cam surface 600) to pinch the sheet of paper 400 between the vacuum cups 170 and a paper stopper 171. This enables the paper 400 to be pulled to a dispose position over pinch rollers 178*a* as shown in FIG. 4E. When the paper picker 70*b* is at the dispose position, the pinch rollers 178*a* are opposed to and are operationally associated with a pair of rollers 178*b*.

Figure 4F:
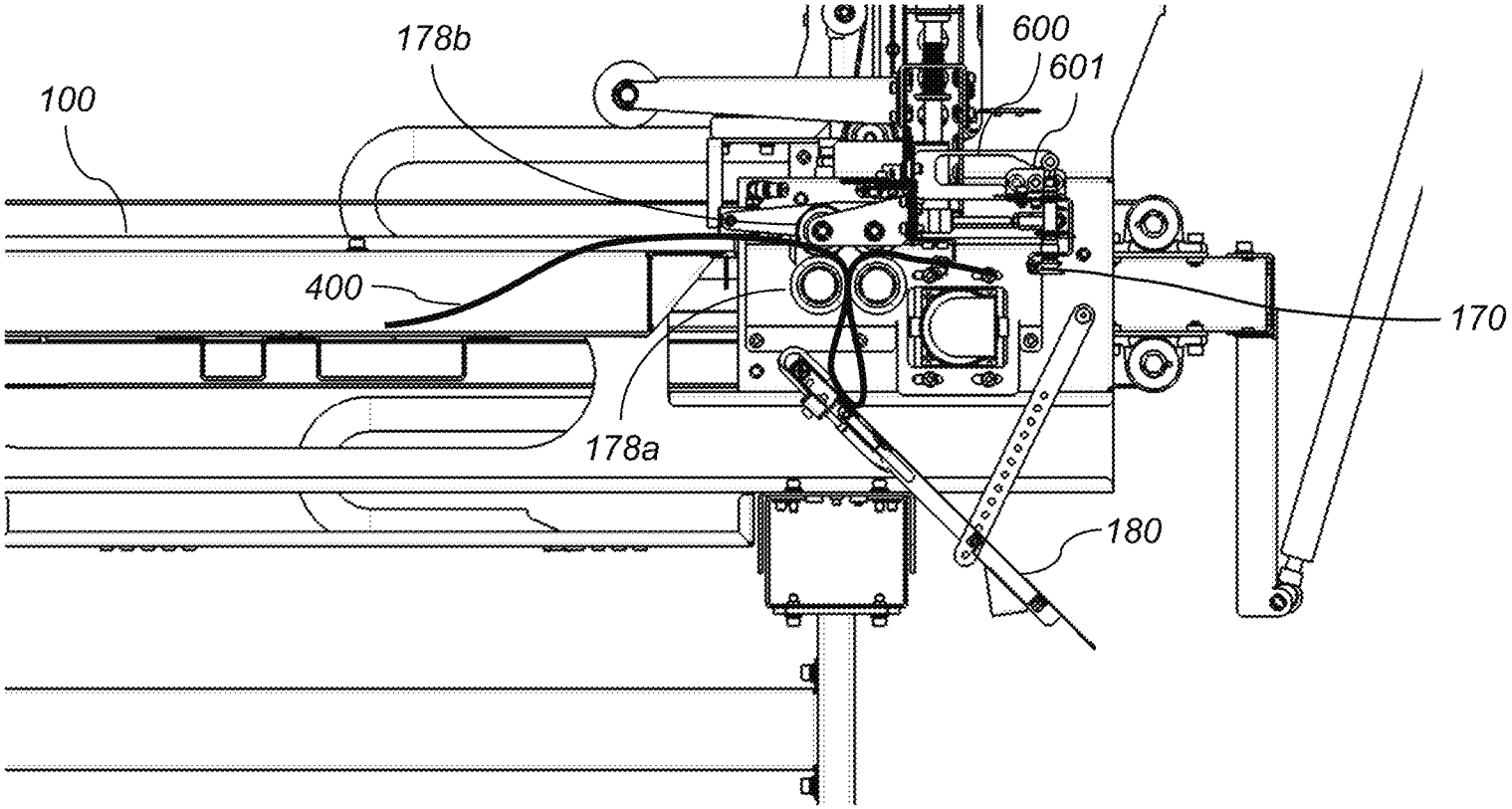

As more clearly shown in FIG. 4F, when the paper picker 70*b* is at the dispose position, the paper 400 is positioned between the pinch rollers 178*a* and rollers 178*b*. The vacuum cups 170 can be pivoted to un-pinch the paper 400 and the pinch rollers 178*a* can be activated to draw the paper 400 between the pinch roller 178*a* and direct the paper 400 to a sloped surface 180 which directs the paper 400 into a paper bin or paper disposal unit 71 (FIG. 3).

The paper picker 70*b* is essentially a bar with vacuum cups 170 that attaches to a piece of paper 400 that is inserted between adjacent printing plates 105, which tweezes it and moves it from a cassette towards pinch rollers 178*a*. The pinch rollers 178*a* cooperate with rollers 178*b* and are adapted to pull the paper 400 down so that it slides upon sloped surface 180 into a paper bin.

As noted above, the paper picker 70*b* moves horizontally and vertically. In an exemplary configuration, the horizontal movement is generated by a DC motor attached to a pully that is connected to a drive belt. However, the present invention is not limited thereto, and the DC motor can be attached to any belt type, rope or cable. The timing belt can be connected to a bracket and transfers the forces generated from the motor to move the paper picker 70*b*. These movements can also be generated by a cylinder (hydraulic and/or pneumatic). The vertical movement can be generated by an actuator 174 such as an air cylinder or hydraulic cylinder or DC motor. As shown, the horizontal and vertical movement can be guided by rails. Alternatively, any mechanism known in the art can be used to move and guide the paper picker 70*b*. As will be described with reference to FIGS. 5A-5E, the movements described above can be detected by sensors at each relevant position which can be adapted to provide a signal to a control device for controlling the operation of the overall device including the plate picker 70*a* and the paper picker 70*b*.

Figure 5A:
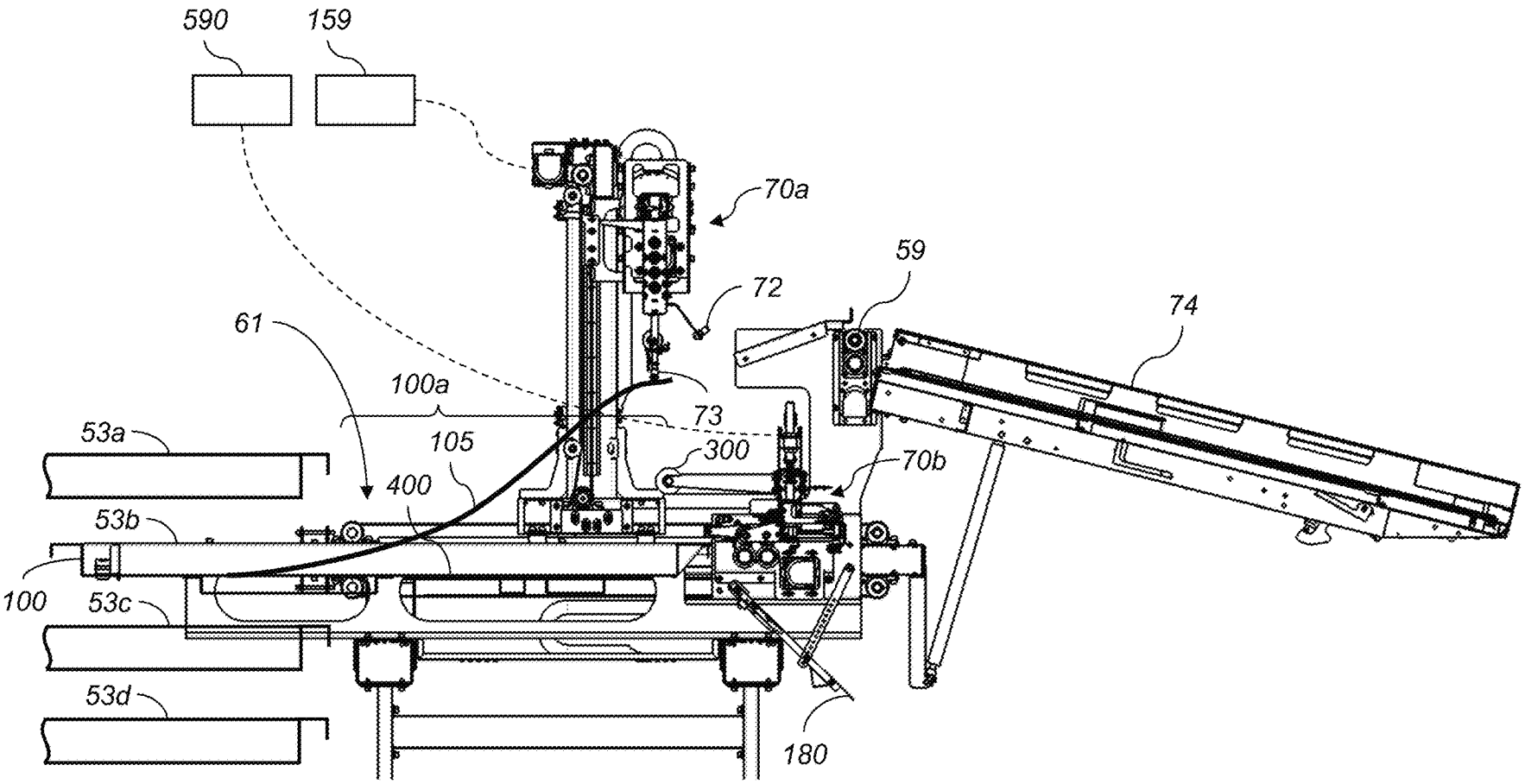
FIGS. 5A-5E illustrate the operation of the exemplary plate picker and paper picker assembly.

Operation of the plate picking and paper picking mechanism will now be described with reference to FIGS. 5A-5E as well as FIGS. 4A-4E. Referring first to FIGS. 5A-5E, these figures illustrate a sequence for picking up a plate 105 and interspersed piece of paper 400, and the interaction between the plate picker 70*a* and the paper picker 70*b*. As shown in FIG. 5A, a selected plate cassette 100 having a plurality of plates and interspersed paper is first moved to an operating or loading position 61 (for example, as shown in FIG. 3). It is noted that the selected plate cassette 100 is part of a plate cassette array 53, wherein the cassettes 53*a*-53*f* in the plate cassette array 53 are vertically stacked in a manner which minimizes the vertical footprint of the plate cassette array 53 as illustrated in FIG. 3. As described with reference to FIG. 3, and also as shown in FIG. 5A, the selected plate cassette 100 is adapted to move to loading position 61 to reveal an exposed portion 100*a*. The vacuum cups 73 of the plate picker 70*a* are then adapted to move in horizontal and vertical directions and to provide a tilting movement as also described with reference to FIGS. 4A and 4B to pick up a top-most printing plate 105 as shown in FIG. 5A. Air blowers 72 can optionally be used to aid in the separation of the printing plate 105 from the underlying paper 400.

Once the printing plate 105 is lifted to the position shown in FIG. 5A, the top surface of an intervening paper 400 is exposed in the exposed portion 100*a* of the selected plate cassette 100 to permit the insertion of the paper picker 70*b* below the lifted printing plate 105. With respect to the plate picker 70*a*, horizontal motor 80 (FIG. 4A) can be activated to move the vacuum cups 73 and the printing plate 105 attached thereto along a plate transport path over guide rollers 300 to direct the plate 105 in a horizontal direction to the position shown in FIG. 5B. In an exemplary embodiment, the guide rollers 300 are positioned above the paper picker 70*b*, preferably as part of the same structure. In other embodiments other types of paper guides besides guide rollers 300 can be used as will be obvious to one skilled in the art. Furthermore, the guide rollers 300 or paper guide can alternately be attached to some other structure besides the structure of the paper picker 70*b*.

Figure 5B:
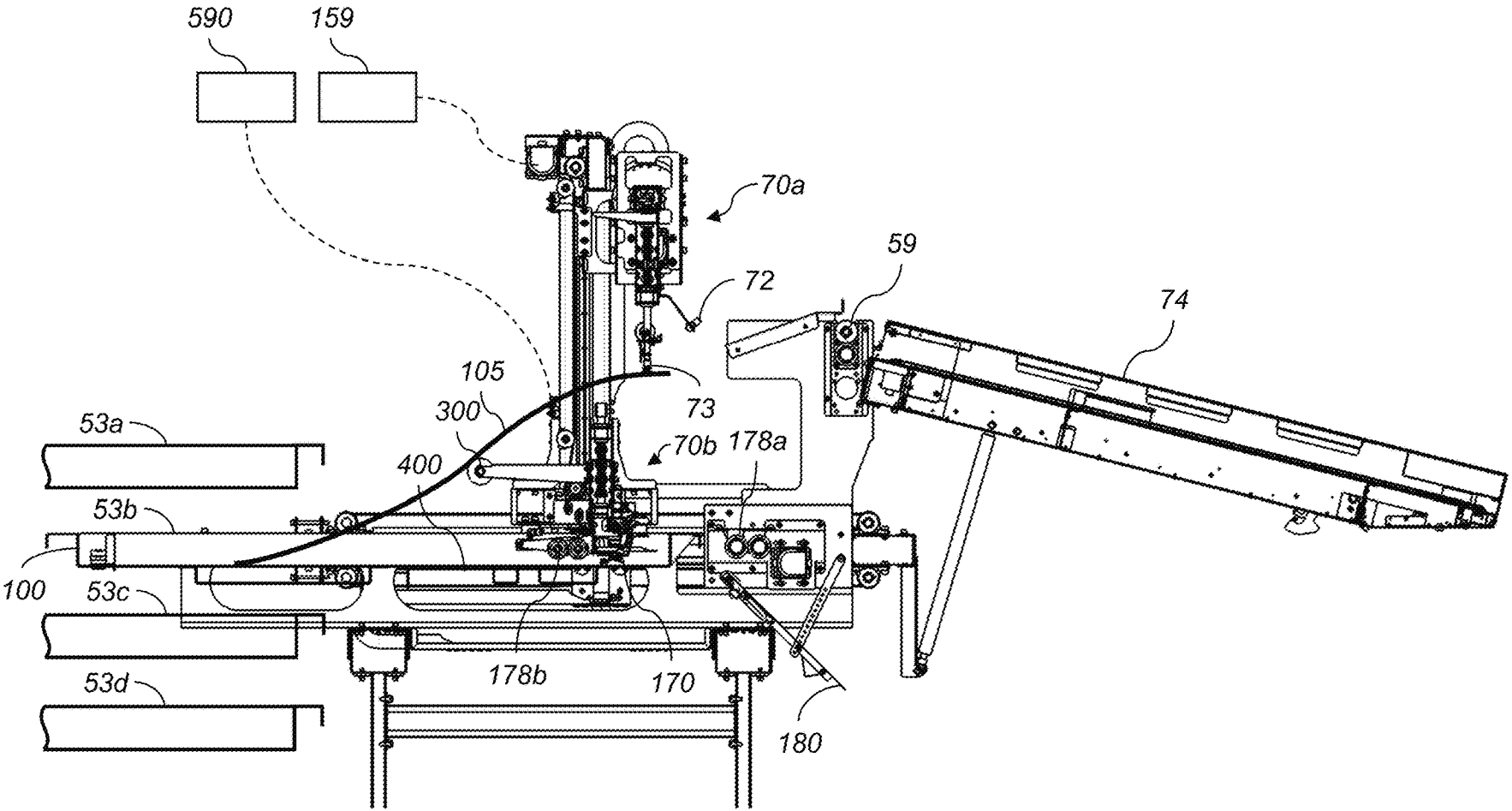

As shown in FIG. 5B, the plate picker 70*a* with vacuum cups 73 convey the printing plate 105 along the plate transport path to pinch rollers 59 which guide the printing plate 105 to an imaging or CTP device via the conveyor 74. As noted, sensors associated with the position of the plate picker 70*a* can cooperate with further sensors along the plate transport path and can be adapted to provide signals to a plate picker motion control system 159 (also referred to as a control device) indicative of the position of the picked-up printing plate 105 and/or the plate picker 70*a* to permit and/or facilitate an automated control of the process based on the position of the printing plate 105 and/or the plate picker 70*a*. The plate picker motion control system 159 controls the motion of the plate picker 70*a* according to a specified plate picker motion pattern by controlling motion control components such as motors. In a similar manner the plate picker motion control system 159 can be adapted to receive feedback and/or signals from the motors and drive belts associated with the movement of the plate picker 70*a* or different elements of the plate picker 70*a* to facilitate and/or control operation of the system.

Figure 5C:
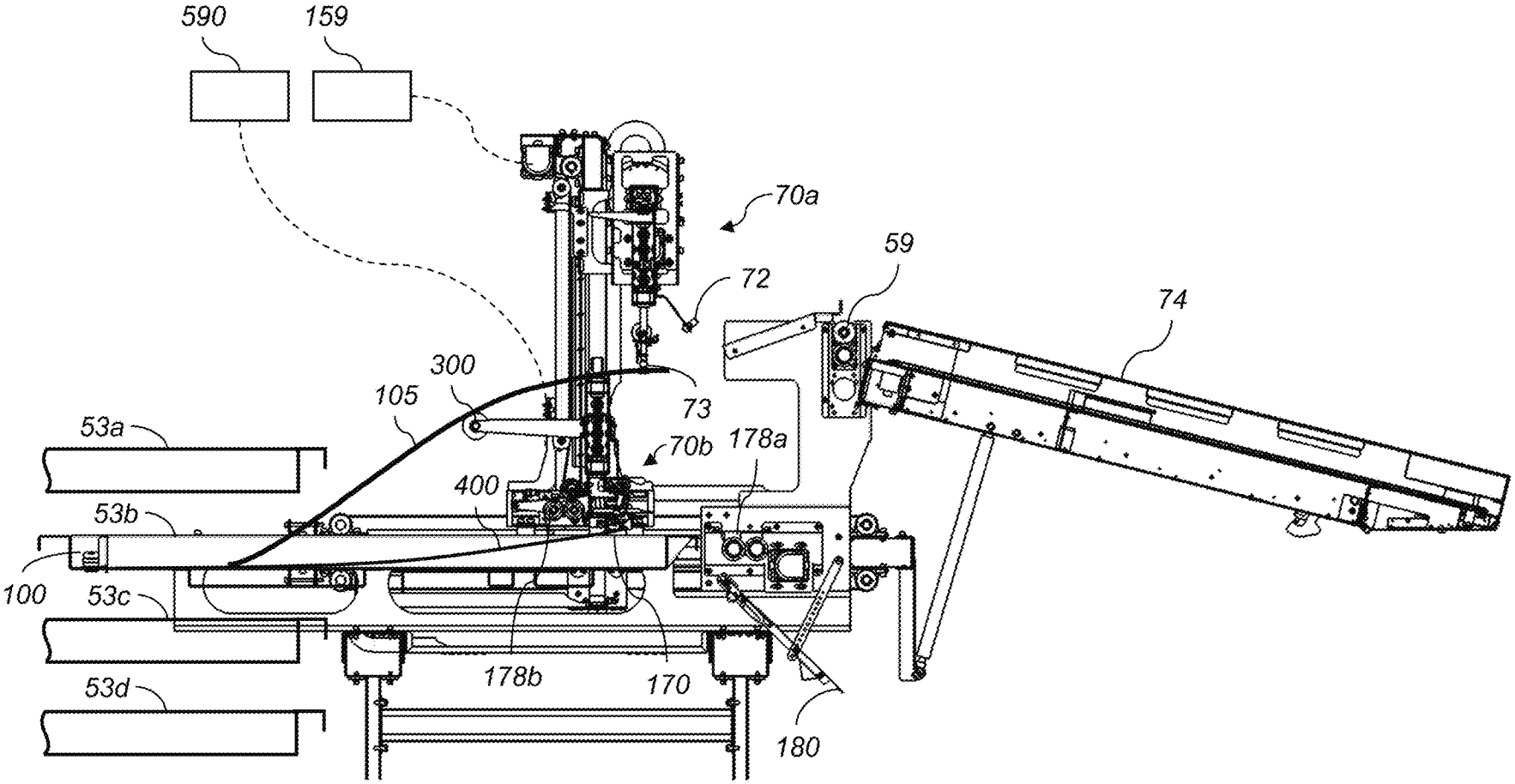

As shown in FIG. 5C, as the printing plate 105 is in the process of being picked up and conveyed, the paper picker 70*b* is moved to an operative position which permits the vacuum cups 170 to attach to and pick up the paper 400 below the picked-up printing plate 105 and convey the paper 400 to the pinch rollers 178*a*. As discussed with reference to FIGS. 4C and 4D, in an exemplary configuration the movement of the paper picker 70*b* and paper vacuum cups 170 in the horizontal direction is achieved through the use of the actuator and motors. The tilting movement of the paper vacuum cups 170 can be achieved through the combination of a roller 601 which follows a cam surface 600 when driven by a known driving mechanism such as a motor to move the vacuum cups between a substantially horizontal position as shown in FIG. 4F and a tilted position as shown in FIG. 4E.

Figure 5D:
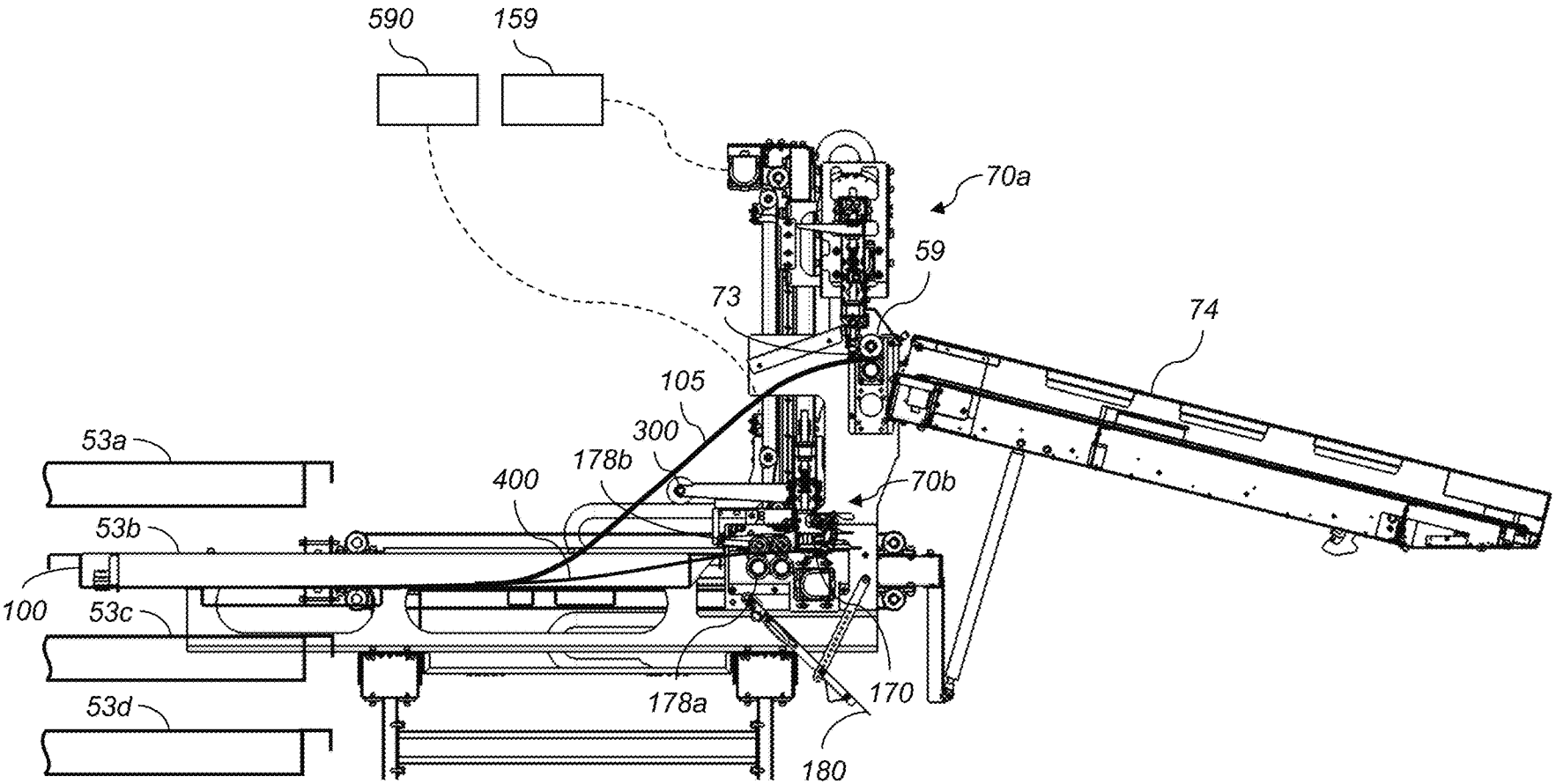

As illustrated in FIG. 5D, the paper picker 70*b* is adapted to move the paper 400 to a position where the pinch rollers 178*b* oppose the pinch rollers 178*a* and the paper 400 is attached to the vacuum cups 170. Tilting of the paper picker 70*b* and the vacuum cups 170 through the roller 601 and cam surface 600 place the rollers 178*b* in a tangent or opposing position with respect to the pinch rollers 178*a* to ensure that the paper is driven downward direction (see FIG. 5E and FIG. 4F). Additionally, the vacuum cups 170 are operated through the use of the motors and actuators as shown in FIGS. 4C and 4D to pull the paper from the cassette while the pinch rollers 178*a* are operated to direct the paper 400 downward through the pinch rollers 178*a* directly to a paper disposal unit 71 (FIG. 3) or alternatively to sloped surface 180 that directs the paper to a paper disposal unit 71.

As described with respect to the plate picker 70*a*, sensors are provided along the paper transport path or are associated with the paper picker 70*b* to detect the position of the paper 400 and/or paper picker 70*b* and provide a signal to a paper picker motion control system 590 that is adapted to control a motion of the paper picker 70*b* according to a specified motion pattern to enable the paper 400 to follow the paper transport path as shown in FIGS. 5A-5E and FIGS. 4D-4E. More specifically, sensors associated with the position of the paper picker 70*b* can cooperate with further sensors along the paper transport path and be adapted to provide a signal to the paper picker motion control system 590 indicative of the position of the paper 400 and/or the paper picker 70*b* to permit and/or facilitate an automated control of the process based on the position of the printing plate 105, the plate picker 70*a*, the paper 400 and/or paper picker 70*b*. The paper picker motion control system 590 controls the motion of the paper picker 70*b* according to a specified paper picker motion pattern by controlling motion control components such as motors. In a similar manner, the paper picker motion control system 590 can be adapted to receive feedback and/or signals from the motors and drive belts associated with the movement of the paper picker 70*b* or different elements of the paper picker 70*b* to facilitate and/or control operation of the system.

Figure 5E:
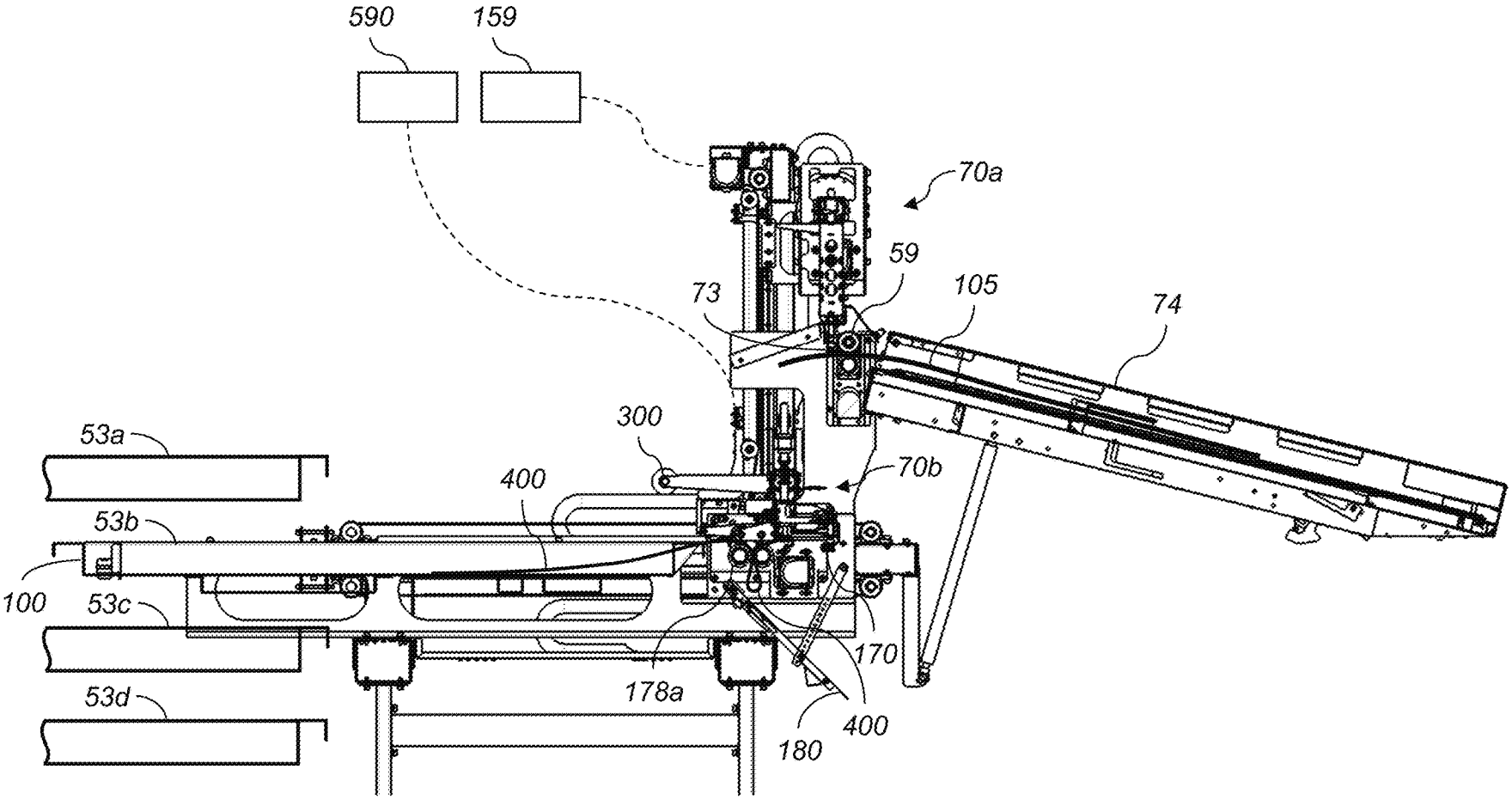

FIG. 5C illustrates the picked-up printing plate 105 being moved toward the pair of pinch rollers 59 through the use of the plate picker 70*a* and the paper picker 70*b* being positioned to begin the movement of the interspersed paper 400 located below the picked-up printed plate 105 from the cassette 100. As the printing plate 105 is conveyed through the use of the pinch rollers 59 into an imaging or CTP device as shown in FIG. 5D, the paper 400 is positioned so as to be held by the vacuum cups 170 and located between the rollers 178*b* and the pinch rollers 178*a* as shown. FIG. 5E (as well as FIG. 4F) show the paper 400 being fed through the pinch roller 178*a* toward the sloped surface 180 to be directed into paper disposal unit 71 (FIG. 3). As shown in FIG. 4F, in order to permit the paper 400 to be driven by the pinch rollers 178*a* into the paper disposal unit 71, the vacuum cups 170 are controlled to release the paper 400.

Figure 6:
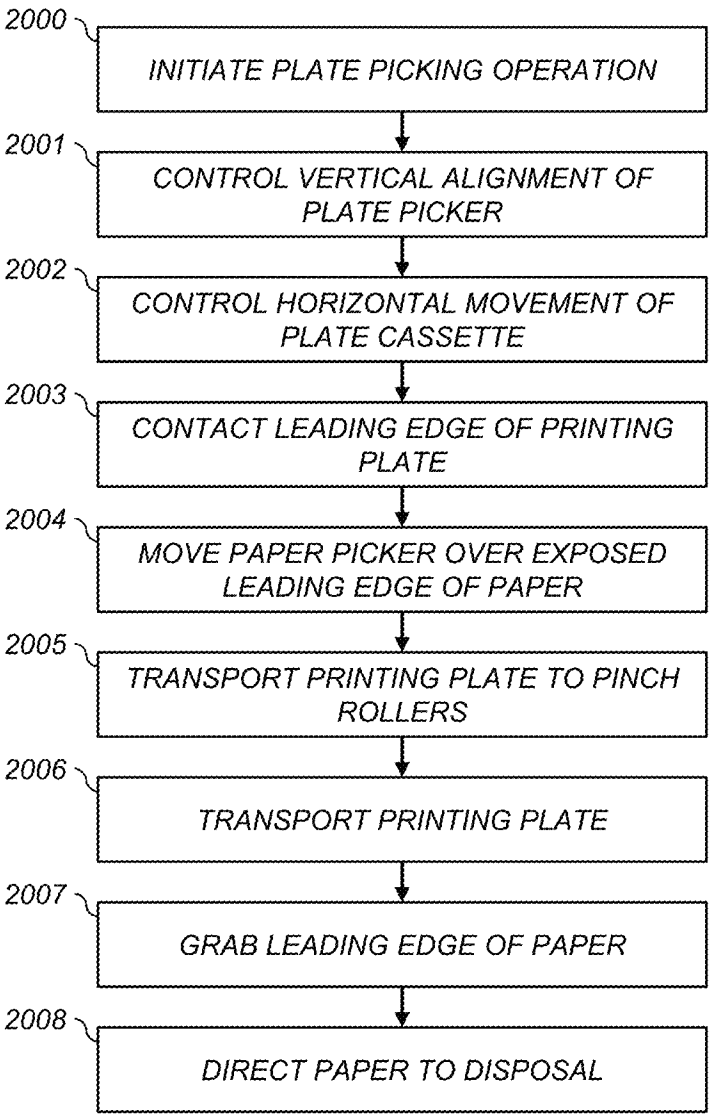
FIG. 6 shows a flow chart of the operation of the printing plate picking mechanism in accordance with an exemplary embodiment.

In a feature of the present invention, the plate picker motion control system 159 and paper picker motion control system 590 are adapted to work together in an integrated manner or separately to control an operation of the system. FIG. 6 illustrates a flow chart showing an operation of the system and process in accordance with a feature of the invention based on the plate picker motion control system 159 and the paper picker motion control system 590. As shown in FIG. 6, a first step comprises initiating an initiate plate picking operation step 2000. Thereafter, in a control vertical alignment of plate picker step 2001, the plate picker motion control system 159 is adapted to proceed with the operation by controlling a vertical alignment of plate cassette array 53 (FIG. 3) such that a selected plate cassette 100 in the set of plate cassettes 53*a*-53*f* is aligned with the plate picker 70*a*.

A control horizontal movement of plate cassette step 2002 controls the movement of the selected plate cassette 100 in the horizontal direction to move the plate cassette 100 into the plate loading position 61 to provide an exposed portion 100*a*, which exposes the leading edge of the topmost printing plate 105 in the selected plate cassette 100.

In a contact leading edge of printing plate step 2003, the plate picker 70*a* is controlled to contact and hold the leading edge of the topmost printing plate 105 and lift it in a vertical direction exposing the leading edge of the topmost sheet of paper 400 in the selected paper cassette 100 (see FIG. 5A).

In a move paper picker over exposed leading edge of paper step 2004, the paper picker 70*b* is controlled to move the paper picker 70*b* over the exposed leading edge of the topmost sheet of paper 400 in the selected paper cassette 100 (see FIG. 5B).

In a transport printing plate to pinch rollers step 2005, the plate picker 70*a* is controlled by the plate picker motion control system 159 to transport the topmost printing plate 105 over the plate guide (e.g., guide rollers 300) of the paper picker 70*b* and feed the leading edge of the topmost printing plate 105 into the plate transport pinch rollers 59 (see FIGS. 5C-5D).

In a transport printing plate step 2006, the plate transport pinch rollers 59 are controlled to direct the topmost printing plate 105 along the plate transport path toward the imaging unit 1 (FIG. 1) via the conveyor 74. In a grab leading edge of paper step 2007, the paper picker 70*b* is controlled to grab the leading edge of the topmost sheet of paper in the selected plate cassette 100 (FIGS. 5B-5C).

In a direct paper to disposal step 2008, the topmost sheet of paper 400 is transported along a paper transport path and the topmost sheet of paper 400 is directed into the paper disposal unit 71 (see FIGS. 5D-5E).

It should be noted that the steps controlling the motion of the printing plate 105 (e.g., steps 2003, 2005, 2006) are generally done in parallel with the steps controlling the motion of the paper 400 (e.g., steps 2004, 2007, 2008). For example, the transport printing plate to pinch rollers step 2005 will preferably be performed simultaneously with the direct paper to disposal step 2008 such that the printing plate 105 and the sheet of paper 400 are both being moved together. This enables the process to be faster than if the steps were performed sequentially and further enables the protection of the underlying plate or next plate in the stack to be picked by assuring that paper is always positioned between the picked up plate 105 and the next plate 105 in the stack.

The invention has been described in detail with particular reference to certain preferred embodiments thereof, but it will be understood that variations, combinations, and modifications can be affected by a person of ordinary skill in the art within the spirit and scope of the invention.

PARTS LIST 1 imaging unit
3 autoloader unit
5 plate cassette array
10 printing plate handling system
20 plate picking mechanism
22 plate stack
23 plate
24 plate support device
24*a* upper surface
25 vertical gap
26 plate support
27 plate picking arrangement
29 lifting cups
31 conveying arm
33 paper lifting and conveying mechanism
35 sheet of paper
39 rollers
50 plate picking mechanism
53 plate cassette array
53*a* plate cassette
53*b* plate cassette
53*c* plate cassette
53*d* plate cassette
53*e* plate cassette

53*f* plate cassette
55 printing plate
57 spacing
59 pinch rollers
61 loading position
70 plate picker and paper picker mechanism
70*a* plate picker
70*b* paper picker
71 paper disposal unit
72 blower
73 vacuum cups
74 conveyor
75 motor
76 drive belt
77 rail
77*a* rail
77*b* rail
80 motor
81 drive belt
82 motor
83 rail
100 selected plate cassette
100*a* exposed portion
105 printing plate
140 vertical alignment system
145 plate cassette movement mechanism
159 plate picker motion control system
170 vacuum cups
171 paper stopper
172 rail
174 actuator
175 drive belt
176 rail
177 motor
178*a* pinch roller
178*b* rollers
180 sloped surface
300 guide rollers
400 paper
590 paper picker motion control system
600 cam surface
601 roller
2000 initiate plate picking operation step
2001 control vertical alignment of plate picker step
2002 control horizontal movement of plate cassette step
2003 contact leading edge of printing plate step
2004 move paper picker over exposed leading edge of paper step
2005 transport printing plate to pinch rollers step
2006 transport printing plate step
2007 grab leading edge of paper step
2008 direct paper to disposal step

The invention claimed is:

1. A printing plate picking mechanism, comprising:
(i) plate transport pinch rollers adapted to direct a printing plate along a plate transport path;
(ii) a paper disposal unit;
(iii) a plate cassette stacking mechanism including:
(a) an array of plate cassettes, each plate cassette adapted to hold a plurality of printing plates separated by intervening sheets of paper, and
(b) a plate cassette movement mechanism adapted to move a selected plate cassette to a printing plate loading position thereby exposing a leading edge of a topmost printing plate in the selected plate cassette;
(iv) a plate picker adapted to contact and hold the leading edge of the topmost printing plate and transport it to the plate transport pinch rollers;
(v) a paper picking unit including:
(a) a paper picker adapted to contact and hold a leading edge of a topmost sheet of paper in the selected plate cassette and transport said topmost sheet of paper to the paper disposal unit as said topmost printing plate held by said plate picker is transported to said plate transport pinch rollers, wherein said topmost sheet of paper and topmost printing plate are transported substantially simultaneously; and
(b) a plate guide positioned above the paper picker, said plate guide forming a part of said plate transport path to guide the printing plate held by said plate picker to said plate transport pinch rollers; and
(vi) a vertical alignment system adapted to move the array of plate cassettes or the plate picker and the paper picking unit in a vertical direction to vertically align the plate picker and the paper picking unit with the selected plate cassette.

2. The printing plate picking mechanism according to claim 1, further comprising:
(vii) a paper picker motion control system adapted to control motion of the paper picking unit according to a specified motion pattern; and
(viii) a control system adapted to:
control the vertical alignment system to vertically align the plate picker and the paper picking unit with the selected plate cassette;
control the plate cassette movement mechanism to move the selected plate cassette in the horizontal direction to the plate loading position to expose the leading edge of the topmost printing plate in the selected plate cassette;
control the plate picker to contact and hold the leading edge of the topmost printing plate and lift it in a vertical direction exposing the leading edge of the topmost sheet of paper in the selected paper cassette;
control the paper picker motion control system to move the paper picking unit over the exposed leading edge of the topmost sheet of paper in the selected paper cassette;
control the plate picker to transport the topmost printing plate over the plate guide of the paper picking unit and feed the leading edge of the topmost printing plate into the plate transport pinch rollers;
control the plate transport pinch rollers to direct the topmost printing plate along the plate transport path;
control the paper picker to grab the leading edge of the topmost sheet of paper in the selected plate cassette; and
control the paper picker motion control system to transport the topmost sheet of paper along a paper transport path and direct the leading edge of the topmost sheet of paper into the paper disposal unit.

3. The printing plate mechanism according to claim 1, wherein the plate picker includes a plurality of vacuum cups adapted to apply a vacuum force onto the plate to lift the plate.

4. The printing plate mechanism according to claim 1, wherein the plate guide includes guide rollers.

5. The printing plate mechanism according to claim 1, wherein the plate picker includes air blowers adapted to facilitate a separation between a lifted plate and an adjacent sheet of paper.

6. The printing plate mechanism according to claim 1, wherein the plate cassettes in said array of plate cassettes are aligned in a stack and said plate cassette movement mechanism is adapted to move the selected plate cassette in a horizontal direction to said printing plate loading position to expose the leading edge of the topmost plate.

7. The printing plate mechanism according to claim 1, wherein said paper picking unit further includes at least one pair of opposing rollers, said plate picker being adapted to transport a sheet of paper to said at least one pair of opposing rollers and said at least one pair of opposing rollers being adapted to pull the sheet of paper into said paper disposal unit.

8. A printing plate picking mechanism, comprising:

(i) plate transport pinch rollers adapted to direct a printing plate along a plate transport path;

(ii) a paper disposal unit;

(iii) a plate cassette stacking mechanism including:

(a) an array of plate cassettes, each plate cassette adapted to hold a plurality of printing plates separated by intervening sheets of paper; and (b) a plate cassette movement mechanism adapted to move a selected plate cassette to a printing plate loading position thereby exposing a leading edge of a topmost printing plate in the selected plate cassette;

(iv) a plate picker adapted to contact and hold the leading edge of the topmost printing plate and transport it to the plate transport pinch rollers in a first direction and orientation along the plate transport path while maintaining said orientation;

(v) a paper picking unit including;

(a) a paper picker adapted to contact and hold a leading edge of a topmost sheet of paper in the selected plate cassette and transport the sheet of paper in said first direction along a paper transport path as said plate held by said plate picker is transported to said plate transport pinch rollers, such that said paper and printing plate are transported substantially simultaneously; and (b) a plate guide positioned above the paper picker, said plate guide forming a part of said plate transport path, wherein the printing plate held by said plate picker is transported over said plate guide to said plate transport pinch rollers, said plate transport path being located on a first side of said plate guide and said paper transport path being located on a second side of said plate guide opposite to said first side, wherein said plate held by said plate picker is transported along said first side of said plate guide as said paper held by said paper picker is transported along said second side of said plate guide in said first direction; and (vi) an alignment system adapted to move the array of plate cassettes or the plate picker and the paper picking unit in a vertical direction to align the plate picker and the paper picking unit with the selected plate cassette.

9. The printing plate mechanism according to claim 8, wherein the plate cassettes in said array of plate cassettes are vertically aligned in a stack and said cassette movement mechanism is adapted to move the selected plate cassette in a horizontal direction to said printing plate loading position to expose the leading edge of the topmost plate.

10. The printing plate mechanism according to claim 8, wherein said paper picking unit further includes at least one pair of opposing rollers, said plate picker being adapted to transport a sheet of paper along said paper transport path to said at least one pair of opposing rollers and said at least one pair of opposing rollers being adapted to pull the sheet of paper into said paper disposal unit.

* * * * *